US008899430B2

(12) United States Patent
Giesbers

(10) Patent No.: US 8,899,430 B2
(45) Date of Patent: Dec. 2, 2014

(54) FREIGHT CONTAINER

(75) Inventor: Rene Giesbers, Ridderkerk (NL)

(73) Assignee: Cargoshell Holding B.V., Rotterdam (NL)

( * ) Notice: Subject to any disclaimer, the term of this patent is extended or adjusted under 35 U.S.C. 154(b) by 0 days.

(21) Appl. No.: 14/004,827

(22) PCT Filed: Mar. 16, 2012

(86) PCT No.: PCT/NL2012/050162

§ 371 (c)(1), (2), (4) Date: Oct. 28, 2013

(87) PCT Pub. No.: WO2012/125037

PCT Pub. Date: Sep. 20, 2012

(65) Prior Publication Data

US 2014/0042157 A1 Feb. 13, 2014

(30) Foreign Application Priority Data

Mar. 17, 2011 (NL) ..... 2006413

(51) Int. Cl.

*B65D 88/10* (2006.01)
*B65D 90/00* (2006.01)
*B65D 88/52* (2006.01)

(52) U.S. Cl.

CPC ..... *B65D 88/10* (2013.01); *B65D 88/524* (2013.01); *B65D 90/004* (2013.01); *B65D 90/008* (2013.01)

USPC ..... 220/1.5; 220/4.33

(58) Field of Classification Search

CPC ..... B65D 88/121; B65D 88/12; B65D 7/30; B65D 7/26; B65D 7/24; B65D 11/186; B65D 11/1833; B65D 90/08; B65D 90/02; B65D 9/22; B65D 9/24; B65D 9/18; B65D 9/14; B65D 9/12; B65D 9/32

USPC ..... 220/7, 6, 4.33, 4.28, 1.6, 1.5, 693, 692; 206/600, 386; 217/13, 12 R, 45, 43 R, 8

See application file for complete search history.

(56) References Cited

U.S. PATENT DOCUMENTS 2,623,565 A * 12/1952 Unthank ..... 220/9.2
3,004,682 A 10/1961 Bertolini et al.

(Continued)

FOREIGN PATENT DOCUMENTS

DE 29714706 12/1998
FR 2040785 1/1971

(Continued)

OTHER PUBLICATIONS

Translation of FR 2040785 (Feuehauf France), Jan. 11, 1971, p. 1.*
International Search Report mailed Oct. 1, 2012, International Patent Application No. PCT/NL2012/050162.

*Primary Examiner* — Robert J Hicks
(74) *Attorney, Agent, or Firm* — Casimir Jones SC

(57) ABSTRACT

A freight container (1) which, for loading freight therein, comprises a bottom (6), a roof (7), two end walls (2) extending between the bottom and the roof, as well as two longitudinal side walls (9, 11) connected to said bottom and said roof, at least one end wall being provided with a hinged door(4, 5) comprising at least two door parts (4, 5), which are each connected by hinge constructions (21, 23, 25) on one side to a frame beam (3) extending between the bottom and the roof, which door parts can be locked from outside by an operator.

9 Claims, 5 Drawing Sheets

(56) References Cited

U.S. PATENT DOCUMENTS

| | | | | |
|---|---|---|---|---|
| 3,398,850 | A * | 8/1968 | Kennard | 220/6 |
| 4,577,772 | A | 3/1986 | Bigliardi | |
| 5,417,332 | A * | 5/1995 | Gearin et al. | 211/85.8 |
| 5,890,612 | A * | 4/1999 | Coppi | 220/7 |
| 2012/0248100 | A1* | 10/2012 | Lancaster et al. | 220/1.5 |

FOREIGN PATENT DOCUMENTS

| | | |
|---|---|---|
| GB | 1418406 | 12/1975 |
| GB | 2206377 | 1/1989 |
| WO | 2006/024104 | 3/2006 |
| WO | 2007/081556 | 7/2007 |
| WO | 2010/085785 | 7/2010 |

* cited by examiner

FREIGHT CONTAINER

The invention relates to a freight container which, for loading freight therein, comprises a bottom, a roof, two end walls extending between the bottom and the roof, as well as two longitudinal side walls connected to said bottom and said roof, at least one end wall being provided with a hinged door comprising at least two door parts, which are each connected by means of hinge constructions on one side to a frame beam extending between the bottom and the roof, which door parts can be locked from outside by an operator, using locking means.

Such a freight container, also called sea container, is generally known, it is frequently used in ports, for example, for shipping goods. A drawback of the conventional freight containers is the fact that they are of relatively heavy construction, so that transporting and moving the known freight containers requires a relatively great deal of energy, which constitutes a burden to the environment.

It is an object of the present invention to provide a freight container that is lighter in weight.

This object is accomplished with the freight container according to the present invention in that the freight container is moreover provided with strengthening means, not being the locking means, for taking up the forces being exerted on the container in use in the closed position of the door, which strengthening means comprise at least one opening and at least one pin, one of which two strengthening means is provided in the door part, near the upper edge and/or the bottom edge, whilst the other strengthening means is provided in a frame beam that extends between the longitudinal side walls, wherein said opening and said pin are oriented in such a manner relative to each other that the pin will automatically slip into the opening upon closure of the door part, being accommodated in said opening with a tight fit, without play, in the closed position of the door part, whilst the pin will automatically move out of the opening upon opening of the door part.

Using such strengthening means it is possible to use a thinner construction of the frame beams, the end walls, the longitudinal side walls and also of the door parts themselves, independently of the material of which the freight container is made, than in the conventional freight containers, which provides a significant saving in weight without the strength of the freight container being affected. As a result of the reduction in weight of the freight container, transporting and moving an empty or loaded container will require less energy. In addition, the strengthening means according to the invention do not increase the weight of the freight container, because the weight of the material removed for providing the opening is substantially the same as that of the material needed for providing the pin. In conventional freight containers, as for example known from FR-2,040,785 and GB 1,418,406, the use of strengthening means generally leads to an increase in weight. Both in FR-2,040,785 and in GB 1,418,406 the strengthening elements are made up of strengthening plates attached to a door part, which leads to an increase in weight of the freight container. The freight container according to the present invention only comprises an opening and a pin as the strengthening means, without any additional strengthening means such as a strengthening plate. It is of course possible to use several openings and pins in a freight container according to the present invention in order to attain the advantages of the invention. In the closed position of the door parts, at least one imaginary right-angled triangle is formed in each of door part by means of the pin present in the opening, which triangle(s) enable(s) the freight container to better withstand high lateral loads. As a result of the tight fit, without play, of the pin in the opening for connecting the door part to the frame, the freight container is strengthened by the virtual strengthening triangle defined between the corners of the door part and the pin, such that the freight container will pass test requirements made of freight containers, such as in particular a so-called "Transverse racking test" (150 kN alternately or simultaneously applied to each top corner on one side of the freight container), without the freight container breaking down or its functionality being affected. In addition, the strengthening means need not be operated by an operator, in contrast to the locking means, but they are automatically connected and disconnected upon opening and closing of the door parts.

In one embodiment of the freight container according to the present invention, the strengthening means is (are) located in a corner in the door part, which corner is formed by a line of intersection between a side of the door part that faces the other door part and the upper edge and/or the lower edge of the door part. By using the largest possible distance between the side via which the door part is attached to the frame beam by means of the hinge constructions and the pin or the opening in the door part, the largest possible virtual right-angled triangle is provided, which maximally protects the freight container against external loads.

A tight fit without play can be achieved by designing the opening and the pin to be correspondingly right-angled or conical. Because of the complementary configuration, the closing of the door will thus be hardly influenced by the strengthening means. In particular, a conical pin having a funnel-shaped opening, its shape corresponding to that of the pin, will provide a very good and user-friendly tight fit.

In a freight container of the collapsible type, the frame is pivotable, and if standard hinges are used a door part can only be opened 90 degrees because of the presence of the longitudinal side wall. In such a freight container it is advantageous, therefore, to opt for a hinge construction that allows the door parts to be opened maximally. In order to make it possible to open the door parts about 180 degrees, the hinge constructions by means of which each door part is connected to the frame beam of the frame must comprise a first hinge, which is connected to a second hinge by means of a centrepiece. Using such a hinge construction, the second hinge can be moved to a position outside the freight container, more in particular to a position beyond the longitudinal side wall, upon opening of the door part. If it is desired for the door part to open through an angle of about 270 degrees, so that the door part can be positioned parallel along or against the longitudinal side wall, the centrepiece must be L-shaped, so that the second hinge can be positioned against or beyond the short end of the longitudinal side wall and the door part can be maximally opened.

The invention will be explained in more detail below with reference to a possible embodiment of the freight container according to the invention as schematically illustrated in the appended figures.

FIG. 1 is a perspective view of a freight container according to the present invention;

FIG. 2*a* is a rear view of a door part of the door of the freight container according to the present invention;

FIG. 2*b* is a sectional view A-A of the door part shown in FIG. 2*a;*

Like numerals indicate like parts in the various figures.

Figure 1:
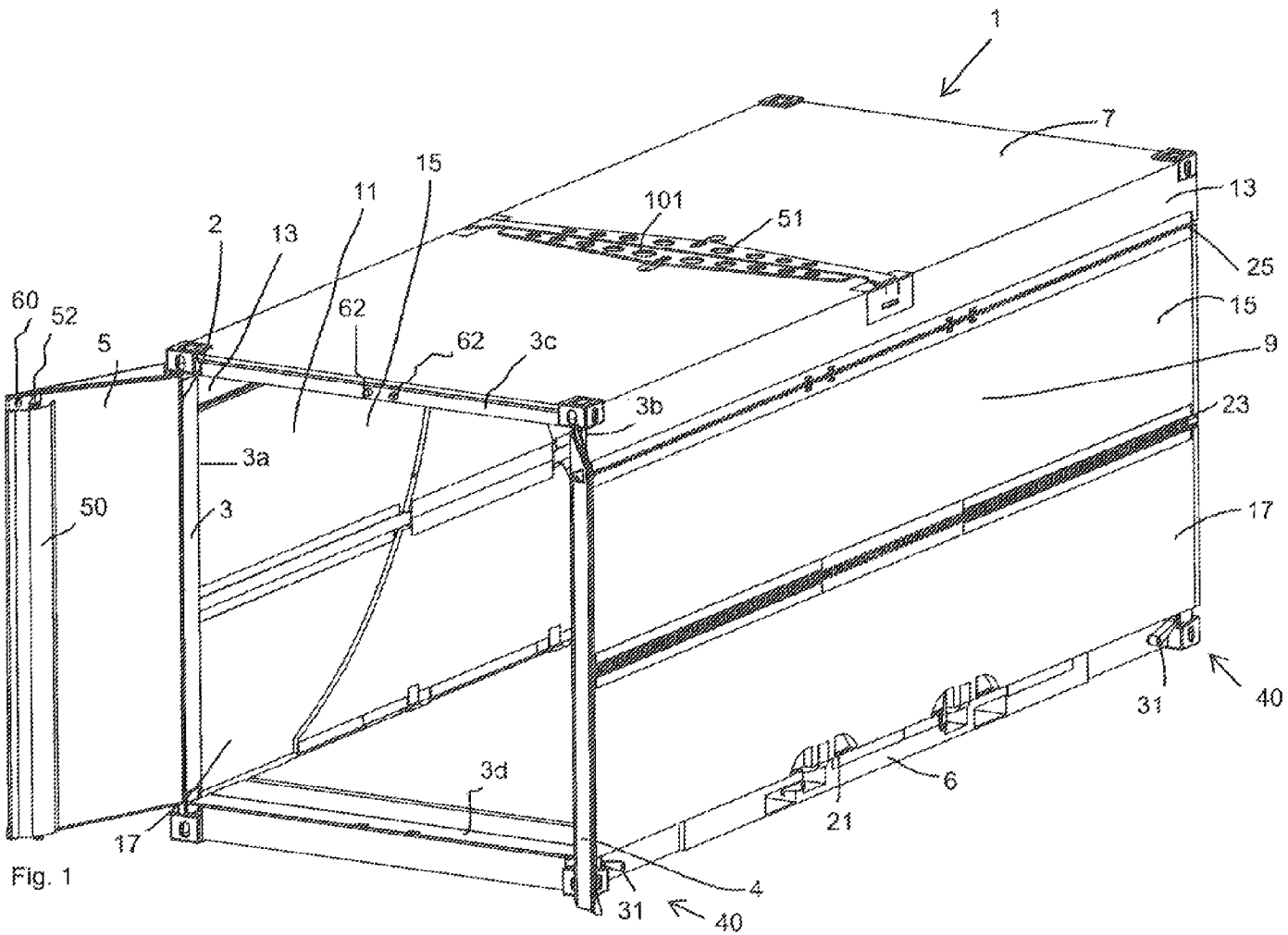
Figure 2A:
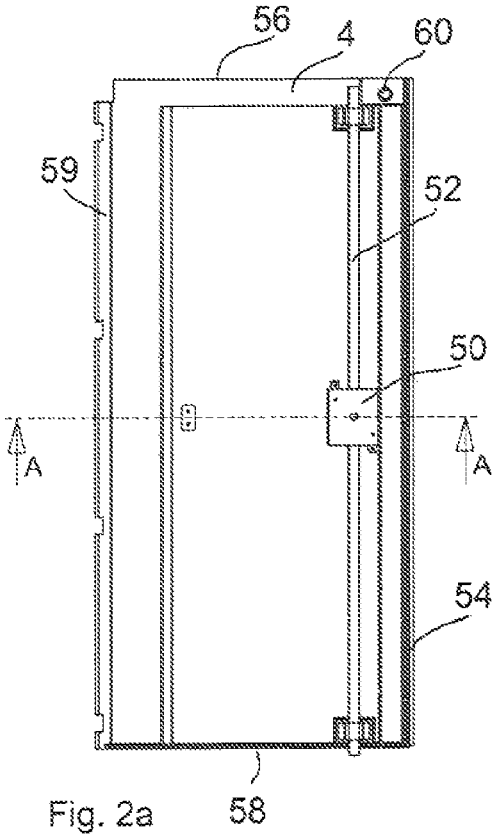
Figure 2B:
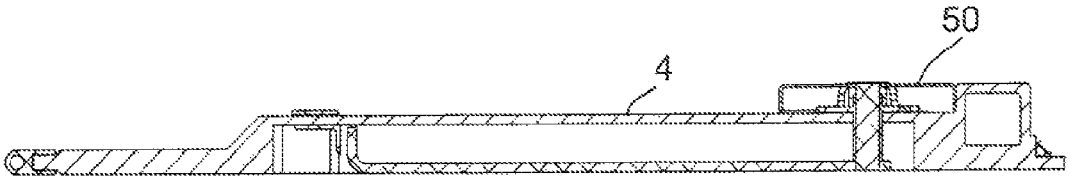

FIG. 1 shows a perspective view of a collapsible freight container 1 according to the present invention. The freight container 1 comprises an end wall 2 provided with a frame 3 with a door comprising door parts 4, 5 which can be opened, so that the interior of the freight container 1, hereinafter called container, will be accessible. In the illustrated embodiment, the other end wall (not shown) does comprise a frame, but it does not comprise any doors. It is of course possible to provide said end wall with the door parts as well.

The collapsible container 1 comprises a bottom 6, a roof 7, the two end walls 2 extending between the bottom and the roof 7 walls 2 (only one of which is shown in the figures) extending between the bottom 6 and the roof 7, as well as two longitudinal side walls 9, 11 connected to the bottom 6 and the roof 7. Each longitudinal side wall 9, 11 has an upper part 13, a central part 15 and a lower part 17, which parts are hingedly connected to each other and to the bottom 6 by means of hinge mechanisms 21, 23, 25 for moving the container 1 from an unfolded condition to a collapsed condition, and conversely, with the roof 7 and the upper part 13 being immovably, i.e. not hingedly, fixed relative to each other, defining a space 30 (see FIGS. 5 and 6) in which the pivotable end walls 2 can be positioned for collapsing the container.

The frame 3 comprises two frame beams 3*a*, 3*b* extending between the bottom and the roof, as well as to frame beams 3*c*, 3*d* extending between the longitudinal side walls, which frame beam 3*d* is more strip-like than beam-like. The frame beams 3*a*, 3*b* and 3*c* can be fixed to the bottom 6 by means of a locking mechanism 40 in the unfolded condition of the container 1, so that the frame 3 can no longer pivot from the vertical position to the horizontal position in the space under the roof 7. The locking mechanism 40 can be operated outside the container by an operator, using a fixing arm 31, and thus be locked and unlocked, with the frame 3 being fixed to the bottom 6 in the locked condition whilst being pivotable about a pivot axis (not shown) in the unlocked condition.

To enable pivoting of the end wall 2, the freight container 1 is provided with an arm 51 disposed on the roof 7 and with two cables (not shown) connected to the arm 51. A guide system comprising rollers guides the cables 53 through the space and along a central part 15 of the longitudinal side wall 9, 11 to the frame 3, to which the cables are attached by fastening means. When the arm 51 is connected to a hook (not shown) of a lifting mechanism, such as a fork-lift truck or a crane, for example, the arm 51 can be moved up together with the cables. As a result of being connected to the cables, the end wall 2 will pivot from the first, vertical position shown in FIG. 1 to a substantially horizontal position in the space 30 defined by the upper parts 13 of the longitudinal side walls 9, 11 and the roof 7. Practically simultaneously therewith, the other end wall (not shown) will be pivoted by means of cables connected to the arm 51 from a first, vertical position to a substantially horizontal position in the space. In the horizontal position of the end walls, the collapsing mechanism of the longitudinal side walls 9, 11 is activated and the container 1 can be folded to a collapsed condition (not shown) by means of the fork-lift truck. To enable unfolding of the container, the container 1 is provided with a second arm 101 disposed beside the first arm 51 on the roof 7.

The above-described freight container is of the collapsible type, which, however, is not relevant to the implementation of the inventive concept in relation to the strengthening means. The strengthening means for strengthening the container 1, which will be explained yet hereinafter, can also be used with (conventional) non-collapsible containers.

FIG. 1 shows a freight container 1 which is provided with the door parts 4, 5, which can be locked to the frame beams 3*a*, the frame beam 3*d* and possibly the bottom 6 from outside by an operator, using locking means 50 comprising a locking rod 52. Such locking means 50 are generally known and will not be discussed in detail herein. In addition to the locking means 50, the freight container 1 comprises strengthening means for taking up the forces being exerted on the container 1 in use in the closed condition thereof. The strengthening means are provided with at least one opening 60 and at least one pin 62, one of which strengthening means, the opening 60 in the example shown, is provided in the door part 4, 5 near the upper edge of the door part 4, 5, whilst the other strengthening means, the pin 62 in the example shown, is provided in the upper frame beam 3*c* that extends between the longitudinal side walls 9, 11, so that the pin 62 will slip into the opening when the door part 4, 5 is being closed, being accommodated in the opening 60 with a tight fit, without play, in the closed position of the door part. The strengthening means 60, 62 do not have a locking function. The strengthening means 60, 62 are not operated by an operator like the locking means 50, therefore, but they are automatically locked together upon closure of the door parts 4, 5 and automatically unlocked upon opening of the door parts 4, 5.

The locking means 60, 62 are provided in a corner in the door part 4, 5, which corner is formed by a side 54 of the door part 4 that faces the other door part and the upper edge 56 and/or the bottom edge 58 of the door part 4, 5. The other hinge side 59 is connected, via hinge constructions 100, to a frame beam 3*a*, 3*b* extending between the bottom 6 and the roof 7.

Figure 3:
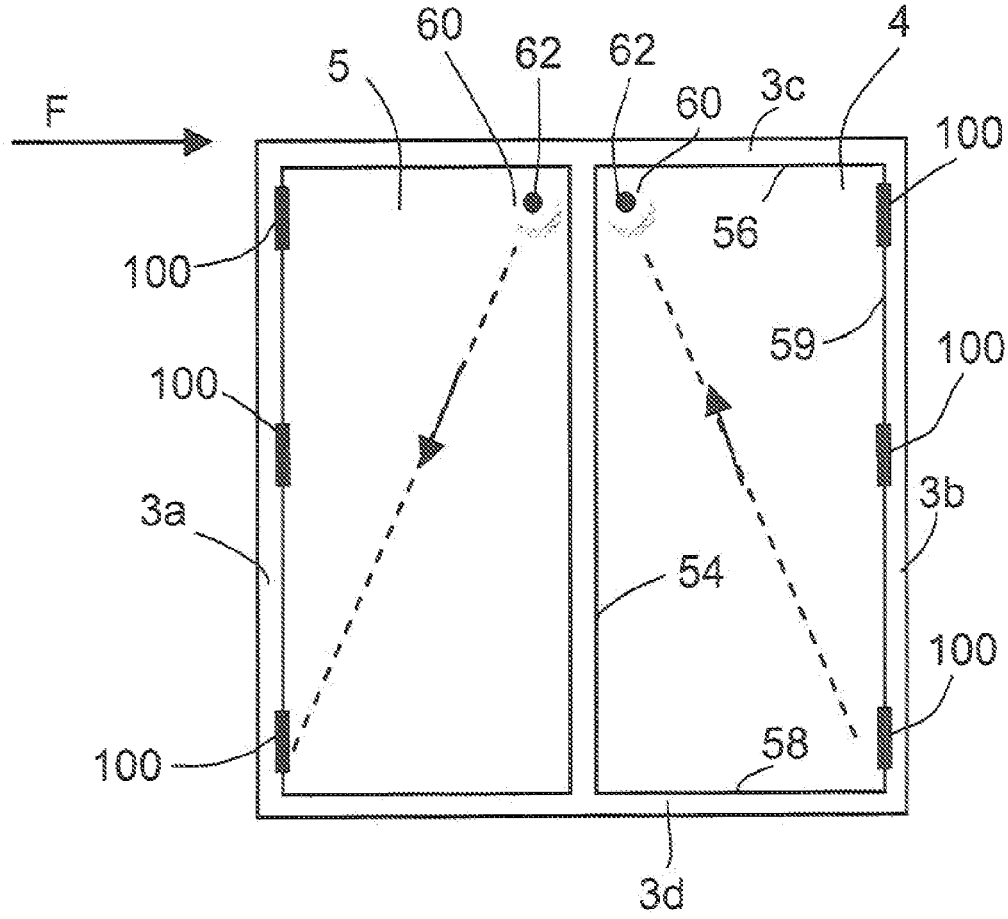
FIG. 3 is a schematic front view of a door of a freight container according to the present invention.
Figure 4:
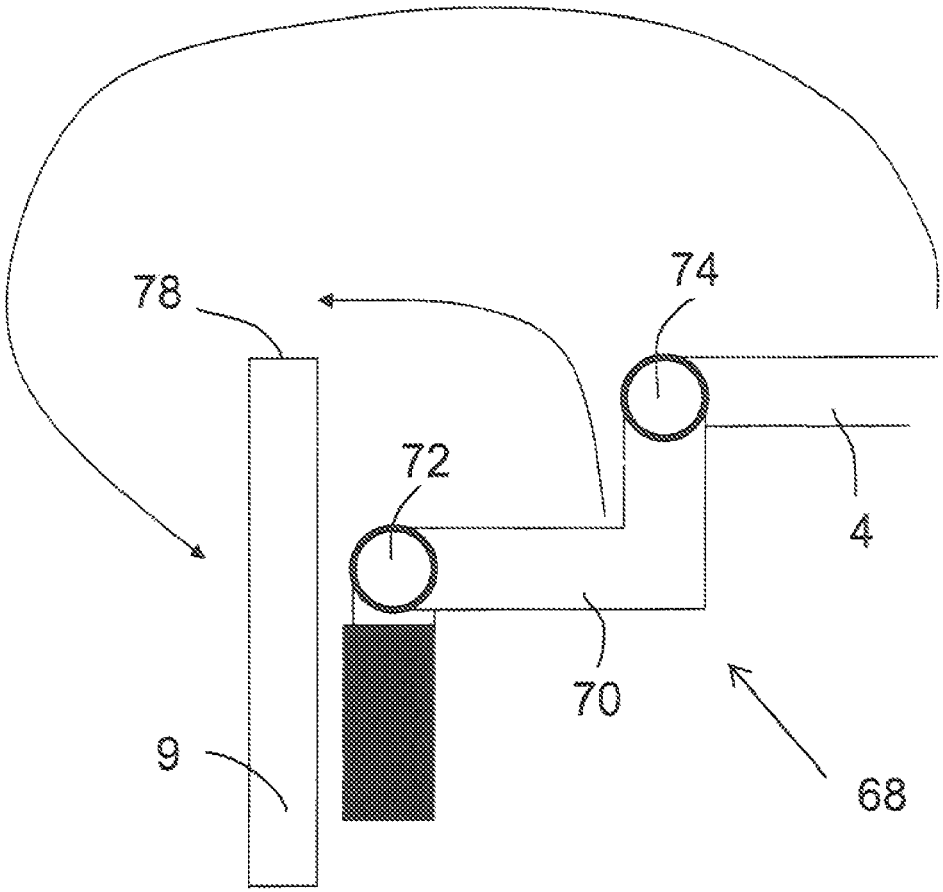
FIG. 4 is a sectional view of a hinge construction of a door of a freight container according to the present invention.

The strengthening means 60, 62 according to the invention moreover do not add to the weight of the freight container, because the weight of the material removed for providing the opening 60 is practically the same as that of the material required for providing the pin 62. Preferably, the pin 62 is conical in shape and the opening 60 has a funnel shape corresponding to the shape of the pin 62. In the closed position of the door parts 4, 5, at least one imaginary right-angled triangle (see the dotted line in FIG. 3) is formed in each door part 4, 5 by the pin 62 present in the opening 60, so that the freight container can better withstand high lateral loads, as exerted in particular during a so-called "Transverse racking test", in which a load of 150 kN is alternately or simultaneously applied to each upper corner on one side of the freight container in the direction indicated by the arrow F in FIG. 3. Because of the tight fit, without play, of the pin in the opening for connecting the door part to the frame, the freight container is strengthened by means of the virtual strengthening triangle defined between the hinge constructions 100 near the corners of the door part 4, 5 and the pin 62, such that the freight container will pass all the inspection requirements made of freight containers.

In a freight container as shown in the figures, the frame 3 is pivotable and, if standard hinges are used, the door part 4, 5 can only be opened 90 degrees on account of the position of the longitudinal side wall 9 relative to the frame 3. It is therefore advantageous to choose a hinge construction for the freight container that makes it possible to open the door parts 4, 5 maximally. The hinge construction 68 is therefore provided with a first hinge 72, which is connected to a second hinge 74 by means of a centrepiece 70. The first hinge 72 is connected to the frame 3, whilst the second hinge 74 is connected to the door part 4. In order to make it possible to open the door parts 4, 5 by an angle of 270 degrees, so that the door part 4, 5 will be positioned parallel to or against the longitudinal side wall 9, the centrepiece 70 of the hinge construction 68 must be L-shaped, so that the second hinge 74 can hinge from a first position through an angle of about 90 degrees about the hinge axis of the first hinge and be positioned against the short end side 78 of the longitudinal side wall 9. The door part can in that case hinge 180 degrees about the hinge pin of the second hinge 74, so that the door part 4 can move through the maximum angle by hinging 90 degrees about the first hinge pin and hinging 180 degrees about the second hinge pin.

A collapsible freight container 1 comprising a bottom, a roof, two end walls extending between the bottom and the roof, as well as two longitudinal side walls connected to the bottom and the roof, each longitudinal side wall having an upper part, a central part as well as a lower part, which parts are hingedly connected to each other as well to the bottom by means of hinge mechanisms for moving the container from an unfolded condition to a collapsed condition, and conversely, wherein the roof and the upper part are immovably fixed relative to each other, forming a space in which the end walls are accommodated in the collapsed condition, wherein at least one end wall is provided with a frame that supports the roof, in which at least one door that can hinge relative to the frame by means of hinge constructions is mounted, which door can hinge from a closed position to an open position in which access to the container is possible for loading or unloading, wherein, for the purpose of collapsing the freight container, the frame with the door in the closed position can be pivoted about a pivot axis from a first position in which it supports the roof to a second position in said space, wherein each hinge construction via which the door is connected to the frame comprises a first hinge which is connected to a second hinge by means of an L-shaped centrepiece. The L-shaped centrepiece is configured so that the second hinge, by hinging about the first hinge pin, can be positioned against or beyond the short end side of the longitudinal side wall.

The freight container 1 according to the present invention is preferably made of lightweight materials, such as composite and aluminium, and the maximum weight of a 20 ft freight container is 1800 kg. It is also possible, however, for the freight container according to the present invention to be made of steel.

Figure 5:
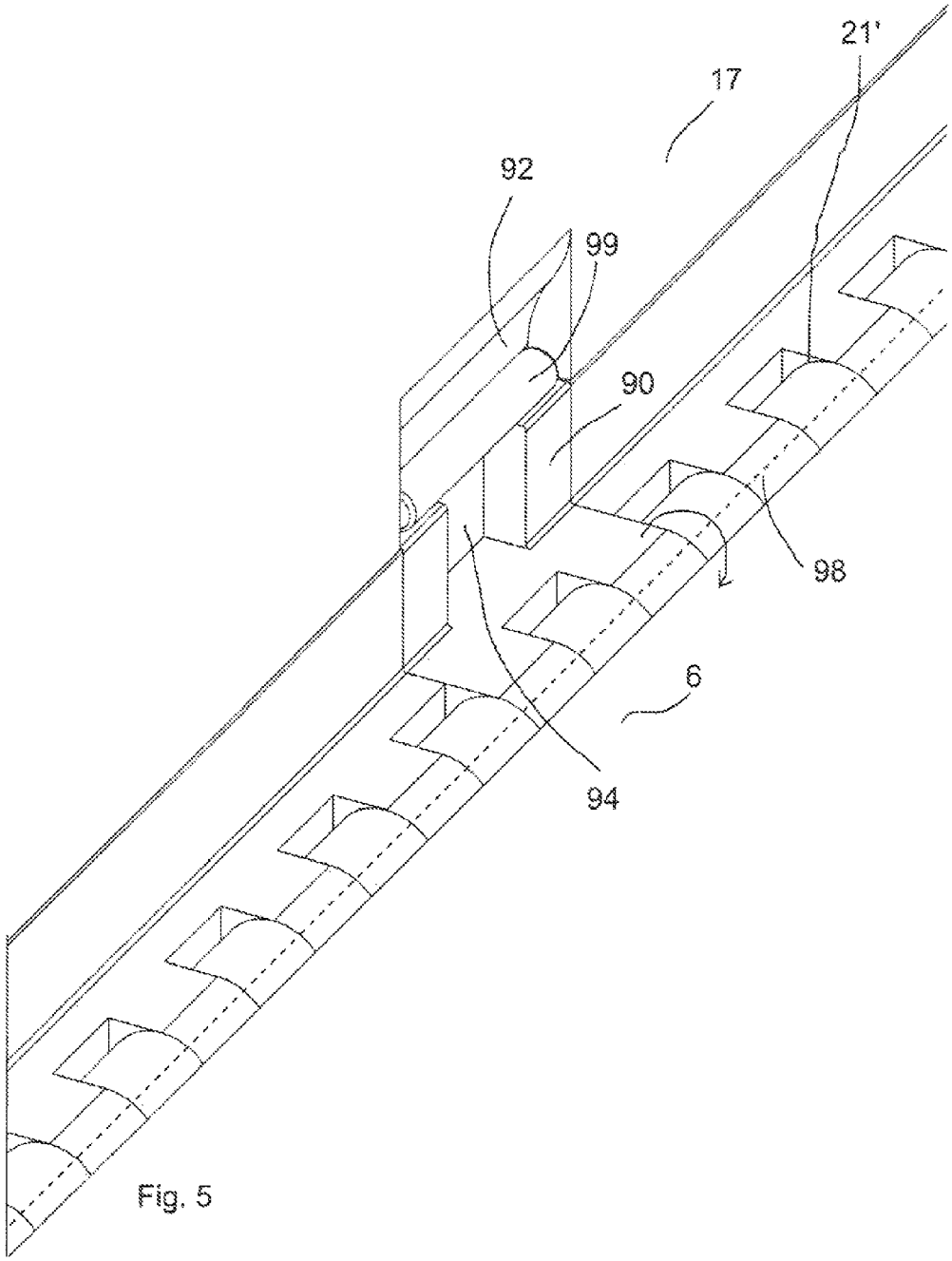
FIG. 5 shows a securing ring integrated in the hinge mechanism for securing cargo in a freight container according to the present invention.

FIG. 5 shows a detail view of the collapsible container 1 shown in FIG. 1, more in particular of a part of the bottom 6, and also of the lower part 17 of the longitudinal side wall 9 that is hinged thereto by means of a hinge mechanism 21'. A drawback of the hinge mechanisms 21 of the collapsible container 1 is the fact that no space is present in the corner between the bottom 6 and the longitudinal side wall 9 for securing rings by means of which the cargo of a container 1 can be secured using ropes or cables. A solution to this is shown in FIG. 5, in which a movable securing ring 90 is integrated in the hinge mechanism 21'. The hinge mechanism 21' is provided with a recess 94 in which the securing ring 90 is accommodated. The securing ring 90 is pivotable about the pivot axis 98 (illustrated in a dotted line) from the position shown in FIG. 5, in which a part 99 of the securing ring is located in a strengthened recess 92 in the lower part 17 of the longitudinal side wall 9, to a position in the interior of the container 1, for example a position in which the part 99 of the securing ring 90 is located on the bottom 6. The pivot axis 98 about which the securing ring 90 pivots is the same pivot axis about which the lower part 17 of the longitudinal side wall 9 pivots for collapsing the container. A collapsible container 1 comprising a bottom, a roof, two end walls extending between the bottom and the roof, as well as two longitudinal side walls connected to the bottom and the roof, each longitudinal side wall having at least two hinged-together parts, which parts are hingedly connected to each other as well to the bottom by means of hinge mechanisms for moving the container from an unfolded condition to a collapsed condition, and conversely, wherein the securing rings 90 described above and shown in FIG. 5 are integrated in the hinge mechanisms.

Although only one strengthening means is shown in the illustrated embodiments, it is also possible to provide each door part with an upper strengthening means and a lower strengthening means, which lower strengthening means couples with a strengthening means provided on the lower frame beam. It is also possible to use only a lower strengthening means instead of the upper strengthening means. If a lower strengthening means is opted for, the lower frame beams 3*d* as shown in the figures must be configured differently, for example with a threshold.

The invention claimed is:

1. A freight container which, for loading freight therein, comprises a bottom, a roof, two end walls extending between the bottom and the roof, as well as two longitudinal side walls connected to said bottom and said roof, at least one end wall being provided with a hinged door comprising at least two door parts, which are each connected by means of hinge constructions on one side to a frame beam extending between the bottom and the roof, which door parts can be locked from outside by an operator, using locking means, characterised in that the freight container is moreover provided with strengthening means, not being the locking means, for taking up the forces being exerted on the container in use in the closed position of the door, which strengthening means comprise at least one opening and at least one pin, one of which two strengthening means is provided in the door part, near the upper edge and/or the bottom edge, whilst the other strengthening means is provided in a frame beam that extends between the longitudinal side walls, wherein said opening and said pin are oriented in such a manner relative to each other that the pin will automatically slip into the opening upon closure of the door part, being accommodated in said opening with a tight fit, without play, in the closed position of the door part, whilst the pin will automatically move out of the opening upon opening of the door part.

2. A freight container according to claim 1, characterised in that the strengthening means is (are) located in a corner in the door part, which corner is formed by a line of intersection between a side of the door part that faces the other door part and the upper edge and/or the lower edge of the door part.

3. A freight container according to claim 1, characterised in that the opening and the pin have corresponding conical, rectangular or round shapes.

4. A freight container according to claim 3, characterised in that the pin is conical in shape and that the opening is funnel-shaped, its shape corresponding to that of the pin.

5. A freight container according to claim 1, characterised in that the freight container can be unfolded and collapsed by means of hinge mechanisms, with the door present in a frame, such that, in order to collapse the freight container, the frame with the door in the closed position can be pivoted about a pivot axis from a first position, in which the frame supports the roof, to a second position, in which the frame is present in a space between the roof and the bottom.

6. A freight container according to claim 5, characterised in that the hinge constructions via which each door part is connected to the frame beam of the frame are provided with a first hinge which is connected to a second hinge by means of a centrepiece.

7. A freight container according to claim 6, characterised in that said centrepiece is L-shaped, wherein the second hinge can be positioned on or beyond the short end side of the longitudinal side wall by means of the second hinge, such that the door part can be opened at most 270 degrees.

8. A freight container according to claim 5, characterised in that securing rings are integrated in the hinge mechanisms for securing cargo.

9. A freight container which, for loading freight therein, comprises a bottom, a roof, two end walls extending between the bottom and the roof, as well as two longitudinal side walls connected to said bottom and said roof, at least one end wall being provided with a hinged door comprising at least two door parts, which are each connected by means of hinge constructions on one side to a frame beam extending between the bottom and the roof, which door parts can be locked from outside by an operator, using locking means, characterised in that the freight container is moreover provided with strengthening means, not being the locking means, for taking up the forces being exerted on the container in use in the closed position of the door, which strengthening means comprise at least one opening and at least one pin, one of which two strengthening means is provided in the door part, near the upper edge and/or the bottom edge, whilst the other strengthening means is provided in a frame beam that extends between the longitudinal side walls, wherein said opening and said pin are oriented in such a manner relative to each other that the pin will automatically slip into the opening upon closure of the door part, being accommodated in said opening with a tight fit, without play, in the closed position of the door part, whilst the pin will automatically move out of the opening upon opening of the door part, wherein the freight container can be unfolded and collapsed by means of hinge mechanisms, with the door present in a frame, such that, in order to collapse the freight container, the frame with the door in the closed position can be pivoted about a pivot axis from a first position, in which the frame supports the roof, to a second position, in which the frame is present in a space between the roof and the bottom, wherein securing rings are integrated in the hinge mechanisms for securing cargo.

* * * * *